US011952718B2

(12) United States Patent
Peng et al.

(10) Patent No.: US 11,952,718 B2
(45) Date of Patent: Apr. 9, 2024

(54) PAPERBOARD AND A METHOD OF PRODUCING A PAPERBOARD

(71) Applicant: Stora Enso OYJ, Helsinki (FI)

(72) Inventors: Frank Peng, Hammarö (SE); Kaj Backfolk, Villmanstrand (FI); Isto Heiskanen, Imatra (FI); Teija Laukala, Lappeenranta (FI)

(73) Assignee: Stora Enso OYJ, Helsinki (FI)

( * ) Notice: Subject to any disclaimer, the term of this patent is extended or adjusted under 35 U.S.C. 154(b) by 180 days.

(21) Appl. No.: 17/417,882

(22) PCT Filed: Jan. 23, 2020

(86) PCT No.: PCT/IB2020/050509
§ 371 (c)(1),
(2) Date: Jun. 24, 2021

(87) PCT Pub. No.: WO2020/157609
PCT Pub. Date: Aug. 6, 2020

(65) Prior Publication Data

US 2022/0074144 A1 Mar. 10, 2022

(30) Foreign Application Priority Data

Jan. 28, 2019 (SE) ..... 1950097-4

(51) Int. Cl.

| | |
|---|---|
| ***D21H 11/18*** | (2006.01) |
| ***D21H 17/67*** | (2006.01) |
| ***D21H 19/52*** | (2006.01) |
| ***D21H 23/28*** | (2006.01) |
| ***D21H 23/48*** | (2006.01) |
| ***D21H 23/50*** | (2006.01) |
| ***D21H 27/10*** | (2006.01) |
| ***D21H 27/32*** | (2006.01) |
| ***D21H 27/38*** | (2006.01) |
| ***D21H 27/40*** | (2006.01) |

(52) U.S. Cl.
CPC ..... *D21H 11/18* (2013.01); *D21H 17/67* (2013.01); *D21H 19/52* (2013.01); *D21H 23/28* (2013.01); *D21H 23/48* (2013.01); *D21H 23/50* (2013.01); *D21H 27/10* (2013.01); *D21H 27/32* (2013.01); *D21H 27/38* (2013.01); *D21H 27/40* (2013.01)

(58) Field of Classification Search
CPC ..... D21H 11/18; D21H 17/67; D21H 19/52; D21H 23/28; D21H 23/48; D21H 23/50; D21H 27/10; D21H 27/32; D21H 27/38; D21H 27/40
USPC ..... 162/141
See application file for complete search history.

(56) References Cited

U.S. PATENT DOCUMENTS

| | | | |
|---|---|---|---|
| 8,608,906 | B2 | 12/2013 | Laleg et al. |
| 2007/0202347 | A1 | 8/2007 | Meazle et al. |
| 2011/0088860 | A1 | 4/2011 | Heijnesson-Hulten et al. |
| 2012/0219816 | A1 | 8/2012 | Heiskanen et al. |
| 2016/0194527 | A1 | 7/2016 | Bloembergen et al. |
| 2019/0024320 | A1 | 1/2019 | Håkansson et al. |

FOREIGN PATENT DOCUMENTS

| | | | |
|---|---|---|---|
| CN | 108474182 | A | 8/2018 |
| EP | 2622133 | A1 | 8/2013 |
| TW | I579428 | B | 4/2012 |
| WO | 2014029917 | A1 | 2/2014 |
| WO | 2017165919 | A1 | 10/2017 |

OTHER PUBLICATIONS

International Search Report from corresponding PCT application No. PCT/IB2020/050509 dated Apr. 2, 2020.
Fengel, D., Ultrastructural behaviour of cell wall polysaccharides, TAPPI, 1970, vol. 53, No. 3, pp. 497-503.
Chinga-Carrasco, Gary, Cellulose fibres, nanofibrils and microfibrils: The morphological sequence of MFC components from a plant physiology and fibre technology point of view, Chinga-Carrasco Nanoscale Research Letters, 2011, 6:417.

*Primary Examiner* — Mark Halpern
(74) *Attorney, Agent, or Firm* — Greer, Burns & Crain, Ltd.

(57) ABSTRACT

The invention discloses a paperboard comprising a base ply, a top ply, and an intermediate layer disposed in-between the at least one base ply and the top ply. The intermediate layer comprises pigment and microfibrillated cellulose (MFC). The application of an intermediate layer comprising pigment and MFC in-between the base ply and the top ply gives rise to improved optical properties of the paperboard, even when using an uncoated top ply having a low grammage This makes it possible to reduce the grammage of the top ply and still obtain good optical properties.

11 Claims, No Drawings

PAPERBOARD AND A METHOD OF PRODUCING A PAPERBOARD

This application is a U.S. National Phase under 35 U.S.C. § 371 of International Application No. PCT/IB2020/050509, filed Jan. 23, 2020, which claims priority under 35 U.S.C. §§ 119 and 365 to Swedish Application No. 1950097-4, filed Jan. 28, 2019.

TECHNICAL FIELD

The present invention relates to a paperboard with improved optical properties and a method of producing such a paperboard.

BACKGROUND

Paperboard is a packaging material which can be converted to different types of packaging solutions depending on the end-use. Typical paperboard grades are Folding Boxboard (FBB), Solid Bleached Board (SBB), Liquid Packaging Board (LPB) and container board to be used in corrugated board. Corrugated board comprises a corrugated medium (fluting) and at least one flat liner or linerboard attached onto a surface of the fluted medium, thus forming a sandwich structure. There are different kinds of corrugated board qualities, and these might comprise different types of liners and corrugated mediums. Examples of different types of liners are kraftliner, white top linerboard and testliner. White top linerboard is used when high quality printing is required. Typically, white top linerboard has a multi-ply structure with one or several base boards comprising unbleached chemical or semi-chemical pulp and a top ply comprising bleached chemical pulp. The top ply may further be coated with mineral based coating.

Paperboard is typically subjected to printing and converting processes to provide a packaging suitable for the end use. The requirement of a good printing surface puts high demands on the appearance of the paperboard. Brightness and opacity are important properties. To improve the white appearance of paperboard, the paperboard manufacturer has traditionally been forced to use pigment coating or a top ply comprising bleached pulp having a high grammage. Environmental concerns have increased the demand for paperboards with lighter weight, thus consuming less raw material.

U.S.2007202347 discloses a two-ply linerboard, wherein an intermediate layer comprising pigments and starch is applied between the layers. In the linerboard described in this publication, a portion of the applied pigment components of the intermediate layer migrate into the top ply and into the base ply, which reduces the optical effect of the pigments.

There remains a need for a light weight paperboard with improved optical properties.

DESCRIPTION OF THE INVENTION

It is an object of the present invention to provide a lightweight paperboard which exhibits improved optical properties and an improved stretchability.

The invention is defined by the appended independent claims. Embodiments are set forth in the appended dependent claims and in the following description.

According to a first aspect, the invention discloses a paperboard, which paperboard comprises at least one base ply, a top ply, and an intermediate layer disposed in-between the at least one base ply and the top ply, wherein the wherein the intermediate layer comprises pigment and microfibrillated cellulose (MFC).

The application of an intermediate layer comprising pigments and MFC in-between the base ply and the top ply gives rise to improved optical properties of the paperboard, even when using an uncoated top ply having a low grammage. This makes it possible to reduce the grammage of the top ply and still obtain good optical properties. Without wishing to be bound to any theory, it is believed that MFC improves the retention of the pigments and that substantially no migration of the pigments into the top or base ply takes place. The invention further reduces the need for chemical retention agents. In addition, the stretchability of the paperboard is improved, whereby cracks at the converting of the board may be diminished.

Microfibrillated cellulose (MFC) shall in the context of the patent application mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods.

The smallest fibril is called elementary fibril and has a diameter of approximately 2-4 nm (see e.g. *Chinga-Carrasco, G., Cellulose fibres, nanofibrils and microfibrils,: The morphological sequence of MFC components from a plant physiology and fibre technology point of view, Nanoscale research letters* 2011, 6:417), while it is common that the aggregated form of the elementary fibrils, also defined as microfibril (*Fengel, D., Ultrastructural behavior of cell wall polysaccharides, Tappi J., Mar.* 1970, *Vol* 53, *No.* 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt %) when dispersed in water. The cellulose fiber is preferably fibrillated to such an extent that the final specific surface area of the formed MFC is from about 1 to about 300 $m^2/g$, such as from 1 to 200 $m^2/g$ or more preferably 50-200 $m^2/g$ when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CM), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size fibrils.

The nanofibrillar cellulose may contain some hem icelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated. MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The above described definition of MFC includes, but is not limited to, the new proposed TAPPI standard W13021 on cellulose nanofibril (CMF) defining a cellulose nanofiber material containing multiple elementary fibrils with both crystalline and amorphous regions.

Paperboard generally relates to strong, thick paper or cardboard used for boxes and other types of packaging. Paperboard is made from bleached or unbleached chemical and/or mechanical cellulose pulp and may be coated or un-coated. The paperboard may have a grammage of between 100-400 gsm or between 150-300 gsm depending on the end use requirements. The paperboard of the invention is a multiply paperboard comprising at least a base ply and a top ply. In one embodiment, the top ply comprises 100 wt % bleached pulp. The multiply paperboard may further comprise several base plies, e.g. a back ply and one or several middle plies. A paperboard ply, such as the base ply and the top ply as used herein refers to a paperboard layer comprising cellulose fibers, preferably comprising at least 50 wt % cellulose fibers, or at least 70 wt % or 80 wt % cellulose fibers calculated on the total weight of said ply. The paperboard may e.g. be linerboard, liquid packaging Board, folding boxboard or solid bleached board. In preferred embodiments, the paperboard is linerboard, most preferably a white top linerboard and most preferably uncoated white top linerboard. The paperboard may be further mineral-, dispersion-, or wax coated with one or several layers, surface sized, pigmented or polymer coated in one or several layers depending on the end-use.

In some embodiments of the invention, the intermediate layer further comprises a co-binder comprising a water soluble polymer. The water soluble polymer may be chosen from the group of starch, preferably uncooked starch, or partly or fully gelatinzed starch, PolyDADMAC, APAM, CPAM, PVA, CMC or other cellulose derivatives and combinations thereof. Such co-binders improve the interply adhesion. In some embodiments, the water soluble polymers might be non-fossil based water soluble polymers. In some embodiments, the water soluble polymer may be a non-fossil based water soluble polymer, such as starch, cellulose derivatives, protein or hemicellulose.

In some embodiments, the intermediate layer comprises MFC in an amount of 10-90 wt % or 30-90 wt %, preferably in an amount of 50-90 wt % or 60-80 wt %, pigments in an amount of 10-70 wt %, preferably in an amount 20-40 wt % and the optional co-binder in an amount of 0-50 wt %, or 0-30 wt % or 0-10 wt % as calculated on the total weight of said intermediate layer. The intermediate layer may consist of MFC, pigments and the optional co-binder. Preferably, the intermediate layer comprises substantially no fibers. The intermediate layer may contain further additives, preferably in an amount of 0-20 wt % or 0.1-20 wt % or 0-10 wt % or 0.1-10 wt %, including e.g. dyes or other optical agents such as optical brighteners, lignin or UV absorbers, a bulking agent such as a bulky fiber, expandable plastic particles, microcrystalline cellulose and/or structuring particles.

The grammage of the intermediate layer is preferably in the range of 0.1-30 gsm, preferably 0.2-20 gsm or most preferably 0.5-15 gsm. The grammage, also sometimes referred to as "basis weight", may be measured according to ISO 536.

The pigment in the intermediate layer is preferably chosen from the group of precipitated calcium carbonate (PCC), titanium dioxide, clay, silica, silicate, nanopigments, plastic pigments, talcum and/or combinations thereof. In a preferred embodiment, the pigment is PCC.

In some embodiments, the pigment comprises pigment particles wherein 90% by volume of said pigment particles have a diameter of less than 5 μm, preferably below 3 μm, most preferably of below 1 μm. The particle size distribution as used herein is determined using dry laser diffraction method, preferably by use of a Malvern Mastersizer 3000 Laser Diffraction System from the company Malvern, UK.

In some embodiments, the PCC pigment and MFC in the intermediate layer are in the form of PCC-MFC complexes wherein the PCC is precipitated onto fibers or fibrils of the MFC. In this embodiment, the retention of the pigments is even further improved. Such PCC-MFC complexes may be produced by carbonation of calcium hydroxide to form precipitated calcium carbonate in the presence of MFC. MFC can e.g. be mixed with an aqueous solution of Ca(OH)2, i.e. milk of lime, whereupon carbon dioxide is introduced to the mixture whereby PCC is at least partly precipitated onto fibers or fibrils of the MFC, forming a PCC/MFC complex. Alternatively, the MFC, milk of lime and carbon dioxide can be added simultaneously to a reactor in a continuous process. Additives, such as salts and morphology controlling agents, can be present during the carbonation process. Additives may e.g. be chosen from the group of magnesium hydroxide, sodium hydroxide and ammonium hydroxide or mixtures thereof. The CaCO3 can crystallize in one or several polymorphs, such of one of the following: calcite, aragonite, vaterite, calcium carbonate monohydrate, calcium carbonate hexahydrate and amorphous material. It is also thus possible that the metastable amorphous calcium carbonate is formed. The PCC may have different morphologies such as rhombohedral, truncated prismatic, scalenohedral, trigonal, orthorhombic/needle and hexagonal crystal systems spheroidal or chain-like agglomerates. It can also be a mixture of two or several morphologies. In alternative processes, the precipitation process can also be started from other raw materials such as salts giving rise to PCC-MFC complexes.

In some embodiments, the PCC pigment is precipitated onto starch granules to form PCC-starch. The starch granules may be gelatinized or swollen. Such PCC-starch complexes can be produced by carbonation of calcium hydroxide to form precipitated calcium carbonate in the presence of uncooked starch. Uncooked starch can e.g. be premixed with milk of lime, whereupon carbon dioxide is introduced to the mixture whereby PCC is at least partly precipitated onto the starch granules. Alternatively, the starch, milk of lime and carbon dioxide may be added simultaneously to the reactor in a continuous process. The pigment may comprise a mixture of PCC-MFC complexes and PCC-starch complexes. In some embodiments, the precipitation of PCC is performed in the presence of MFC together with at least of one of the following: starch, cellulose derivatives such as CMC and/or PVOH.

In some embodiments, the BET specific surface area of the PCC-MFC complexes and/or the PCC-starch complexes is above 5 $m^2/g$, preferably above 10 or above 15 $m^2/g$ or most preferably above 30 $m^2/g$, such as between 5-500 $m^2/g$, or 10-350 $m^2/g$, or 15-100 $m^2/g$, or 30-100 $m^2/g$, as measured using nitrogen and the BET method according to ISO 9277.

The invention is particularly advantageous in linerboard production. In one embodiment, the top ply of the linerboard comprises 100 wt % bleached chemical pulp. In one embodiment, the paperboard is a linerboard and the at least one base ply comprises 50-100 wt % unbleached chemical pulp and 50-100 wt % unbleached CTMP pulp or recycled pulp and wherein the top ply comprises 100 wt % bleached chemical pulp of hardwood or softwood fibers, all percentages calculated on the total weight of the said ply.

The invention enables the paperboard- or linerboard producer to reduce the grammage of the top ply and still achieve a linerboard having a high brightness and which exhibits a low white top mottling. In some embodiments, the grammage of the top ply is below 70 gsm, preferably below 60, and most preferably below 55 gsm, or below 50 gsm, the grammage of the top ply may be between 10-70 gsm, or 20-60, or 20-55 gsm or 30-50 gsm.

The paperboard, or linerboard, may further exhibit a brightness of at least 70%, preferably at least 75% or at least 80% or even at least 85% as measured according to ISO2470-1. The brightness measures the amount of reflectance of blue light. The brightness as expressed herein is measured in accordance with ISO 2470-1.

The linerboard may further exhibit a white top mottling of less than 0.9%, preferably less than 0.7% and most preferably less than 0.5%. White top mottling refers to reflectance variation of unprinted board and is measured using the STFI-Mottling Light v1.0 in accordance with the following: A flatbed scanner is used to collect images and the data is calibrated to reflectance using a calibration set. Small and large scale variations are removed using frequency analysis. The reflectance variations are presented as Coefficient of Variations (COV) divided into wavelength classes. The reflectance variation from 1 to 8 mm are combined into one single mottle According to a second aspect illustrated herein, there is provided a corrugated fiberboard comprising a corrugated medium and the paperboard defined as set out above with reference to the first aspect as a linerboard. The corrugated board may e.g. comprise three layers: the linerboard of the invention as the outer liner, a corrugated medium such as a semi-chemical fluting, and a kraft liner as the inner liner. The corrugated board may further comprise additional corrugated mediums and liners in several layers.

According to a third aspect illustrated herein, there is provided a method to produce a paperboard comprising the steps of forming a base ply, applying a mixture comprising pigments and MFC on the surface of said base ply forming an intermediate layer and applying a top ply on the surface of the intermediate layer. The method to produce a paperboard according to the third aspect of the invention may be further defined by the features of the paperboard according to the first aspect of the invention.

The paperboard of the invention may be made on a conventional paperboard or a linerboard machine, preferably by use of a Fourdrinier machine. The base ply or plies and the top ply may be individually formed by use of several headboxes and several fourdriniers. In this embodiment, the mixture comprising pigments and MFC may be applied on the surface of said base ply on the forming section before the application of the top ply. The mixture may be applied on the base ply when said base ply has a solid content of between 1-60, or preferably between 3-15%.

The mixture comprising pigments and MFC is preferably applied on the surface of the base ply by use of a non-impact application method such as curtain coating or spraying. The most preferred application method is curtain coating, which has shown to give the most even coverage. The coating can be applied in a single step or in several step forming a multilayer coating. In embodiments, the coating is applied in several layers using a multilayer curtain coater. The solid content of the mixture is preferably between 0.5-50 wt % or more preferably between 1-40 wt %, or between 2-30 wt %.

In an alternative method, a multiply headbox may be used to form both the base ply, the top ply and the intermediate layer.

The invention claimed is:

1. A linerboard comprising:

at least one base ply, a top ply, and an intermediate layer applied in-between the at least one base ply and said top ply, wherein the at least one base ply and the top ply are paperboard plies comprising at least 50 wt % cellulose fibers calculated on a total weight of said ply wherein the intermediate layer comprises microfibrillated cellulose (MFC) in an amount of 30-90 wt % and pigment in an amount of 10-70 wt % as calculated on a total weight of said intermediate layer, wherein the pigment comprises precipitated calcium carbonate (PCC), wherein said pigment comprises pigment particles wherein 85% by volume of said pigment particles have a diameter of less than 5 μm.

2. The linerboard according to claim 1, wherein the intermediate layer further comprises a co-binder comprising a water soluble polymer.

3. The linerboard according to claim 1, wherein a grammage of the intermediate layer is in a range of 0.1-30 gsm.

4. The linerboard according to claim 1, wherein the pigment and MFC in the intermediate layer are in the form of PCC-MFC complexes formed by PCC being precipitated onto fibers or fibrils of the microfibrillated cellulose.

5. The linerboard according to claim 1, wherein the pigment comprises PCC precipitated onto one or more starch granules to form PCC-starch complexes.

6. The linerboard according to claim 4, wherein a BET specific surface area of the pigment complexes is above 5 $m^2/g$ according to ISO 9277.

7. The linerboard according to claim 1, wherein a grammage of the top ply is below 70 gsm.

8. The linerboard according to claim 1, which paperboard exhibits a Brightness of at least 70% measured according to I502470-1.

9. The linerboard according to claim 1, wherein the at least one base ply comprises 50-100 wt % unbleached chemical pulp and 50-100 wt % unbleached CTMP pulp or recycled pulp, and wherein the top ply comprises 100 wt % bleached chemical pulp of hardwood or softwood fibers, all percentages calculated on a total weight of the said ply.

10. The linerboard according to claim 1, wherein the linerboard exhibits a white top mottling of less than 0.9%.

11. A corrugated fiberboard comprising: a linerboard according claim 1 and a corrugated medium.

* * * * *